United States Patent [19]

Fordsmand

[11] 3,965,345

[45] June 22, 1976

[54] FIXTURE FOR THE MOUNTING AND COOLING OF FLUORESCENT TUBES

[75] Inventor: Marc Fordsmand, Charlottenlund, Denmark

[73] Assignee: Kicon AG, Ostermundigen, Switzerland

[22] Filed: May 9, 1974

[21] Appl. No.: 468,637

[30] Foreign Application Priority Data

June 26, 1973 United Kingdom ..... 30363/73

[52] U.S. Cl. ..... 240/47; 240/51.11 R

[51] Int. Cl.[2] ..... F21V 29/00

[58] Field of Search ..... 240/9 A, 47, 51.11

[56] References Cited

UNITED STATES PATENTS 3,281,587 10/1966 Quin ..... 240/47

*Primary Examiner*—Richard M. Sheer

*Attorney, Agent, or Firm*—Fleit & Jacobson

[57] ABSTRACT

A combined fixture and cooling device for the mounting and cooling of fluorescent tubes and made by extrusion of a heat conductive material so as to constitute a cooling tube having an upper wall, a pair of side walls and a concave, part-cylindrical lower wall defining a contact face for the upper surface of a fluorescent tube, the side walls of the cooling tube being provided with lengthwise extending ribs or grooves to provide fastening means for mounting the fluorescent tube on the cooling tube with its upper surface in contact with the contact face of the cooling tube.

The fluorescent tube is mounted in sockets associated with cylindrical casings of the same diameter as the fluorescent tubes and including ballast means for the fluorescent tubes, and the cylindrical casings are mounted on the cooling tube by means of spring clips embracing the lower part of the casings and engaging the ribs or grooves of the side walls of the cooling tube.

8 Claims, 12 Drawing Figures

FIXTURE FOR THE MOUNTING AND COOLING OF FLUORESCENT TUBES

Figure 1:
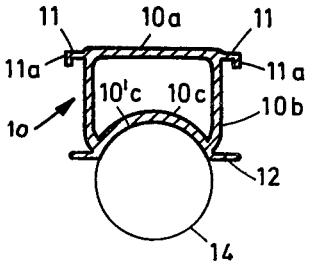

This invention relates generally to fixtures for the mounting and cooling of fluorescent tubes and, more particularly to the combination of such fixtures with sub-ceiling structures.

The main object of the invention to to provide a simple and inexpensive lighting fixture which practically without any constructional modifications will operate directly as cooling means for removing heat from a fluorescent tube mounted in the fixture.

Another object is to provide means whereby the fluorescent tubes may be displaced in their lengthwise direction relatively to the fixture so as to be mounted therein in any convenient position relatively thereto.

A further object is to provide a beam-like structure for supporting the fixture while at the same time providing for the mounting of panels in a sub-ceiling structure including a plurality of lighting fixtures for fluorescent tubes.

Other and ancillary objects will appear from the following description of a preferred embodiment with reference to the accompanying drawings.

The main characteristic feature of the invention is the provision of a cooling tube made by extrusion of a heat conductive material, such as aluminium or an aluminium alloy, and having at least one concave, part-cylindrical wall defining a contact face, said cooling tube being extruded in such a manner as to provide supporting means integral with the walls thereof and extending in the lengthwise direction of the tube. The supporting means may be adapted to suspend a fluorescent tube on the cooling tube so that a part of the cylindrical surface of the fluorescent tube will be held in contact with the part-cylindrical contact face of the cooling tube.

The essential advantage of this feature is that only one element is required for both mounting and cooling the fluorescent tube, and that this element including the supporting means for the fluorescent tube can be produced in a single operation, viz. by extrusion.

Another substantial advantage is that the supporting means formed integral with the cooling tube during the extrusion thereof and extending continuously in the lengthwise direction of the tube will enable the fluorescent tube to be mounted on the cooling tube in any convenient pre-selected position.

Figure 2:
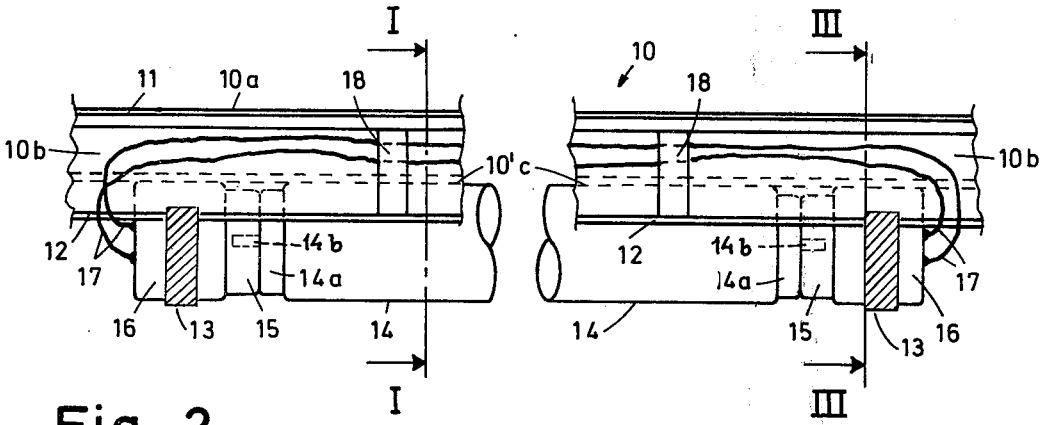
Figure 3:
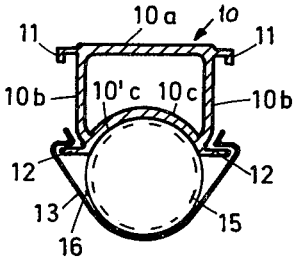
Figure 4:
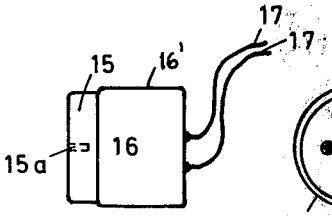
Figure 5:
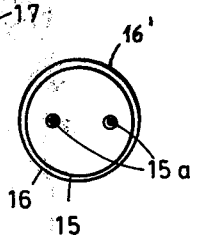
Figure 6:
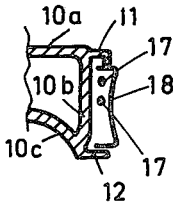
Figure 7:
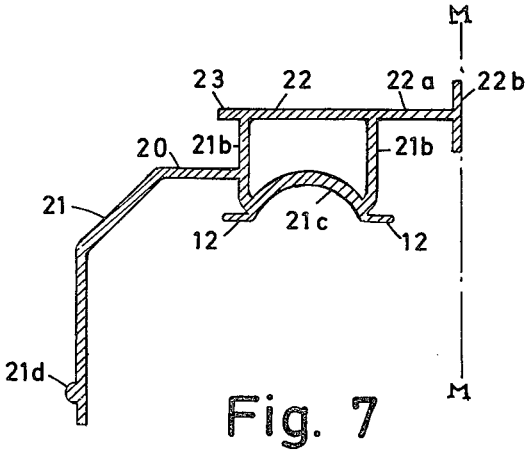
Figure 8:
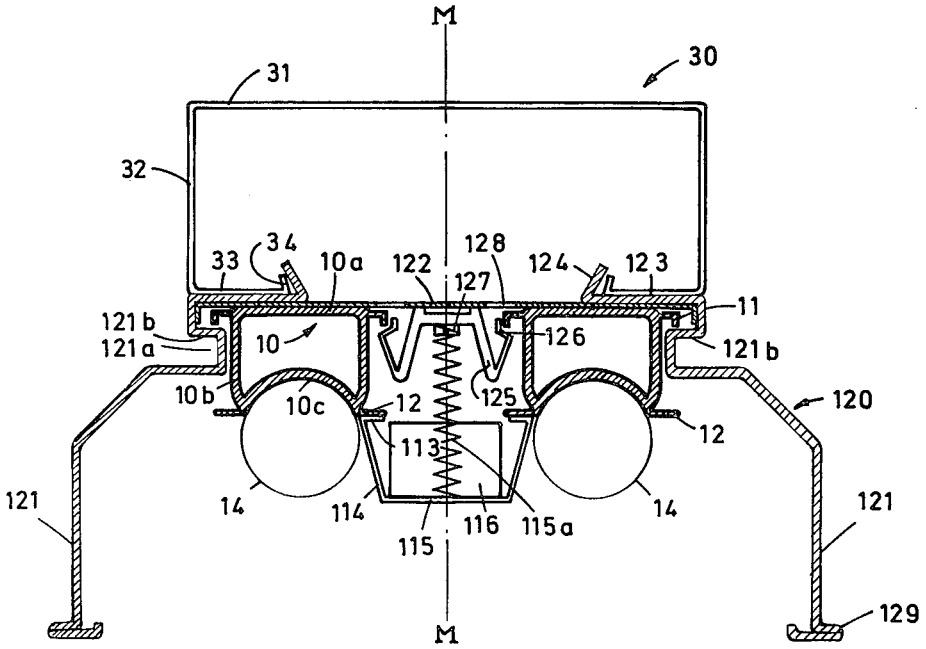
Figure 9:
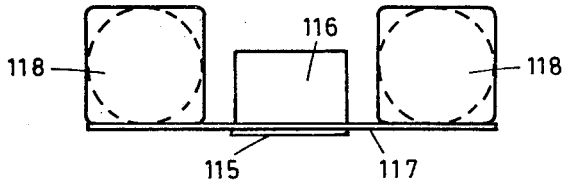
Figure 10:
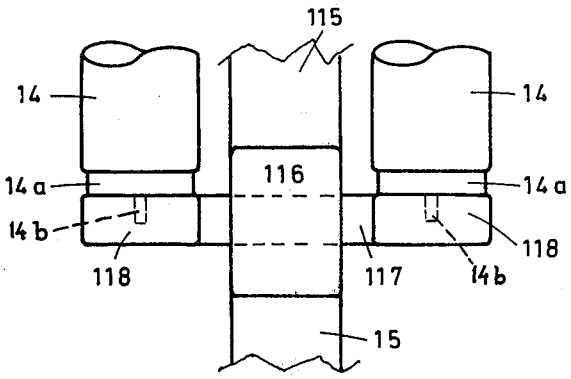
Figure 11:
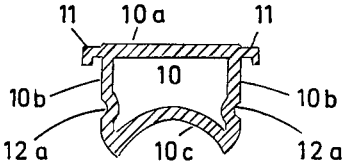
Figure 12:
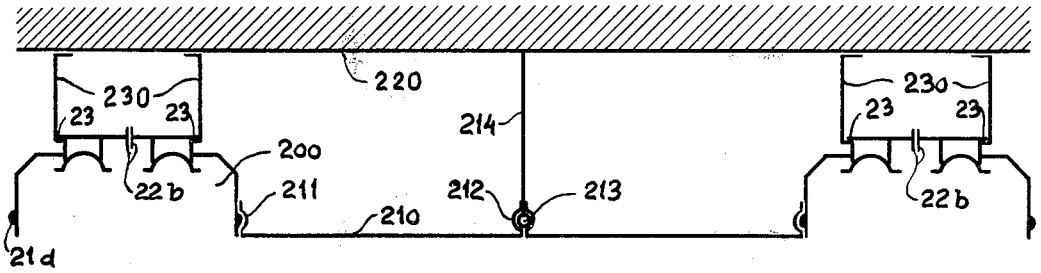

In the drawings:

FIG. 1 is a cross-sectional view of a combined fixture and cooling device according to the invention taken along the line I—I of FIG. 2, FIG. 2 is a side elevation partially in section of the fixture shown in FIG. 1, FIG. 3 is a cross section taken along the line III in FIG. 2, FIGS. 4 and 5 are side and end views respectively of a combined socket and ballast unit for the mounting of a fluorescent tube in the fixture shown in FIGS. 1 — 3, FIG. 6 is a cross-sectional view of one half of the fixture according to the invention showing details of the mounting of electrical leads on the side wall thereof, FIG. 7 is a cross-sectional view showing one half of a combined housing and fixture according to one embodiment of the invention, FIG. 8 is a cross-sectional view of a modified embodiment showing a housing including a pair of fixtures according to FIGS. 1 and 2, FIGS. 9 and 10 are end and top plan views respectively showing a combined socket and ballast unit for mounting a pair of fluorescent tubes in the housing shown in FIG. 8, FIG. 11 is a cross section of a cooling tube showing a modified embodiment of supporting means for mounting a fluorescent tube on the cooling tube, and FIG. 12 is a schematic cross-sectional view of a part of a sub-ceiling mounted by means of beam-elements comprising a combined housing and fixture as shown in FIG. 7.

The basic feature of the invention is illustrated in FIG. 1 which shows a cross-section of a fixture comprising a cooltube generally designated as 10 and made by extrusion of a heat conductive material such as aluminium or an aluminium alloy. This tube is of substantially rectangular cross-section having an upper wall 10*a*, a pair of side walls 10*b* and a lower concave and part-cylindrical wall 10*c* defining a contact face 10′*c* for the upper part of the cylindrical surface of a fluorescent tube 14. Adjacent the corners of the side walls 10*b* and the top wall 10*a* the cooling tube 10 is provided with a pair of lengthwise extending flanges 11 formed integrally with the tube 10 during the extrusion thereof, said flanges having an angular cross section so as to provide a downwardly projecting rib 11*a*. Furthermore, the cooling tube 10 comprises a pair of lengthwise extending ribs 12 likewise integral with the tube and located adjacent the corners of the side walls 10*b* and the lower concave wall 10*c*.

In the embodiment illustrated in FIGS. 1–6 the fluorescent tube 14 is mounted in the fixture 10 with its upper cylindrical surface in heat conductive contact with the contact face 10′*c* by means of the arrangement shown more particularly in FIGS. 2, 3, 4 and 5. The ends of the tube 14 comprising a cylindrical metal cap 14*a* provided with contact pins 14*b* are mounted in the combined socket and ballast units shown in FIGS. 4 and 5. This unit comprises a socket member 15 with recesses 15*a* adapted to receive the contact pins 14*b* and a ballast member 16 enclosed in a cylindrical casing 16 of the same diameter as the fluorescent tube 14. This ballast member which is electrically connected with the fluorescent tube through the socket member 15 and the contact pins 14*b* is mounted on the ribs 12 of the fixture 10 by means of spring clips 13 embracing the lower part of the cylindrical casing of the ballast member 16 so as to urge the ballast member and the fluorescent tube mounted in the socket members 15 upwardly towards the contact face 10′*c*, thereby providing the efficient heat transfer contact between the surface of the fluorescent tube 14 and the ballast member 16 with the wall 10*c* of the cooling tube constituting the fixture. The electrical leads 17 connecting the ballast member 16 and the socket 15 with a current supply source may conveniently be mounted on one side wall 10*b* of the fixture 10 by means of spring clips 18 inserted between the lower ribs 12 and the upper flanges 11 of the fixture 10 as shown in FIG. 6.

In the embodiment shown in FIG. 7 the fixture is extruded integrally with one half of a housing generally designated as 20. In this embodiment the upper flanges 11 of FIGS. 1 and 3 have been omitted since they are no longer required for mounting the fixture within the housing as described more particularly with reference to FIG. 8. In FIG. 7 the housing 20 comprises a side wall 21, the upper part of which defines one side wall 21*b* of a cooling tube having an upper wall 22 integral with the top wall of the housing and a lower concave and part-cylindrical wall 21*c* provided with lengthwise extending ribs 12. The top wall 22 is extended as shown at 22*a* and is provided with an end flange 22*b* adapted to assemble the one half of the housing shown in FIG. 7 with an identical half symmetrically disposed with respect to the median line M—M, so as to constitute a housing structure including a pair of fixtures as shown in FIGS. 1 – 3.

The top left corner of the housing may be provided with a lengthwise extending flange 23 for mounting the structure in a ceiling in a conventional manner (not shown). Finally, the lower end of the side wall 21 may be provided with a lengthwise extending bead or flange 21*d* for mounting sub-ceiling panels as described with reference to FIG. 12.

In FIG. 8 there is illustrated another embodiment of the invention comprising a pair of cooling tubes 10 as described with reference to FIG. 1 mounted within a housing generally designated as 120 and disposed symmetrically with respect to the median plane M—M of the housing.

The housing 120 comprises a pair of side walls 121 and a top wall 122. The side walls 121 which are preferably made of steel plates so as to provide for sufficient mechanical strength of the structure are formed with lengthwise extending recesses 121*a* defining a pair of ledges 121*b* in the interior of the housing, the upper ends of the side walls 121 being bent over at right angles so as to form a pair of horizontal, lengthwise extending flanges 123, the edges of which are provided with inclined flanges 124. The top wall 122 of the housing is clamped in between the flanges 123 of the side walls 121 and the upper surfaces of the top walls 10*a* of the cooling tubes in the following manner:

A double spring element 125, 126 which is symmetrically disposed with respect to the median plane M—M of the housing is mounted by means of a screw 127 or similar fastening means on the lower side of the top wall 122 with its free ends 126 abutting the downwardly projecting ribs 11*a* of the flanges 11 on the cooling tubes 10 as to urge the cooling tubes 10 upwardly towards the flanges 123 while the ribs 11*a* adjacent the side walls 121 are supported on the ledges 121*b*. Thus, due to the action of the spring member 125, 126 the cooling tubes 10 are held firmly within the housing and at the same time the top wall 122 of the housing is sandwiched in between the cooling tubes 10 and the flanges 123 of the side walls 121. Apertures 128 are provided in the top wall 122 to permit an air current to flow from the interior of the housing to an air duct 30 mounted on the top thereof. Finally, the side walls 121 of the housing are provided with lengthwise extending flanges 129 adjacent the lower edges thereof for mounting sub-ceiling panels on the housing as shown in FIG. 6.

The structure according to FIG. 8 constitutes a fixture for mounting and cooling a pair of fluorescent tubes 14 with their upper cylindrical surfaces in heat conductive contact with the contact face 10'*c* of the cooling tubes 10. In this embodiment the fluorescent tubes 14 are mounted in the conventional manner by means of sockets 118, one at either end 14*a* of each fluorescent tube and are electrically connected to ballast means 116 disposed intermediate the two fluorescent tubes. The ballast 116 and the sockets 118 are assembled so as to constitute a unit as shown in FIGS. 9 and 10. This unit comprises a transversely extending bridge element 117 which is mounted on a lengthwise extending base plate 115 resiliently suspended from the top wall 122 of the housing by means of springs 115*a* as shown in FIG. 8. It will be understood, that the unit 116, 117, 118 may be displaceably mounted in any convenient position relatively to the base plate 115 so as to provide for adjustment of fluorescent tubes relatively to the housing in the lengthwise direction thereof. The base plate 115 is provided with upwardly extending flanges 114 the edges of which are bent over so as to provide lengthwise extending lips 113 adapted to contact the lower faces of the ribs 12 on the cooling tubes. The base plate 115 and its flanges 114 are made from a heat conductive material, and thus heat generated in the ballast 116 will be transferred to the ribs 12 and the walls of the cooling tubes 10. Likewise, a substantial part of the heat generated by the fluorescent tubes 14 will be transferred to the walls 10*c* of the cooling tubes and will be absorbed by a coolant flowing therethrough. Additionally, the fluorescent tubes 14 may be air cooled by means of air current flowing from the interior of the housing 120 through the apertures 128 in the top wall 122 thereof into the air duct 30 which comprises a casing having a top wall 31, side walls 32 and bottom flanges 33 provided with bent-over edges 34. These edges 34 are adapted to engage the edges 124 of the side walls 121 of the housing so as to provide for snap-fastening means for mounting and dismounting the air duct 30.

In FIG. 12 there is schematically shown a sub-ceiling structure comprising a plurality of radiant heating or cooling panels 210 suspended from a ceiling proper 220 and supported by beam-like elements 200 each of which is made by the assembly of two fixtures as shown in FIG. 7. These beam-like elements are suspended from the ceiling 220 by means of brackets 230 engaging the flanges 23. The panels 210 are provided with flanges 211 having lengthwise extending recesses adapted to engage the beads 21*d* of FIG. 7 so as to provide snap-fastening means for detachable mounting the panels 210 on the side walls of the beam-like elements 200. The panels 210 are provided with part-cylindrical flanges 212 along edges opposite the flanges 211 adapted to engage a fluid conducting pipe 213 supported from the ceiling 220 by means of brackets 214.

In this manner there is provided a sub-ceiling suspended from the ceiling proper 220 and comprising a plurality of panels 210 which are heat conductively associated with the cooling tubes 10 in the housing 200 and with the fluid conducting pipes 213 and thus providing for heat transfer from the fluorescent tubes 14 to the sub-ceiling.

It will be appreciated that the details of the embodiments described and illustrated may be modified and supplemented in various respects within the limits of the appending claims. In particular, the supporting means for mounting the fluorescent tubes on the cooling tubes are not necessarily limited to the ribs 12 but may be replaced by a pair of lengthwise extending grooves 12*a* as shown in FIG. 11. It will also be understood, that the ends of the cooling tubes 10 and of the casing in which they are mounted should normally be closed by suitable end pieces which, however, form no part of the present invention and have therefore been omitted in the drawings.

What I claim is:

1. A fixture for the mounting and cooling of a fluorescent tube comprising, in combination, a cooling tube of heat conductive material, said cooling tube having a plurality of longitudinally extending walls defining a hollow interior for the circulation of a coolant therethrough, one of said walls being of arcuate cross-sectional shape for accommodating an arcuate portion of the periphery of a fluorescent tube in heat transfer relationship therewith and with the fluorescent tube disposed in substantially parallel relationship with said cooling tube and means on said cooling tube for supporting a fluorescent tube with the fluorescent tube arcuate peripheral portion in said heat transfer relationship with said cooling tube arcuately shaped wall.

2. A fixture in accordance with claim 1 in which said supporting means includes a pair of longitudinally extending, oppositely disposed ribs formed integrally with said cooling tube.

3. A fixture in accordance with claim 1 wherein said supporting means comprises a pair of longitudinally extending, oppositely disposed grooves formed integrally with said cooling tube.

4. A fixture in accordance with claim 1 wherein said supporting means comprises a pair of longitudinally extending, oppositely disposed ribs formed integrally with said cooling tube and adjacent the longitudinally extending side edges of said arcuately shaped wall and including a pair of longitudinally extending, oppositely disposed flanges formed integrally with said cooling tube, said flanges being disposed on said cooling tube oppositely of said ribs.

5. A fixture in accordance with claim 2 including a socket arranged to be positioned at each end of a fluorescent tube for mounting engagement with the associated end of the fluorescent tube and wherein said supporting means include a spring clip for connecting each of said sockets in supported relationship with said pair of ribs.

6. A fixture in accordance with claim 2 including a socket arranged to be positioned at each end of a fluorescent tube for mounting engagement with the associated end of the fluorescent tube and ballast means electrically connected to each of said sockets, a cylindrical casing in enclosing relationship with each of said ballast means and connected to its associated socket, said casing having an outer diameter corresponding to the outer diameter of a fluorescent tube, said supporting means including a substantially U-shaped, spring clip having a pair of free ends and disposed in underlying relationship with each of said casings and means for detachably connecting said free ends of said spring clips to said cooling tube so as to urge said casings and a fluorescent tube against said cooling tube arcuately shaped wall with peripheral portions of said casings and the fluorescent tube in heat transfer relationship therewith.

7. A fixture in accordance with claim 6 including electrical leads for connecting said sockets and said ballast means with an associated source of electric power and means including a plurality of longitudinally spaced spring clips for retaining said leads adjacent the outer surface of said cooling tube.

8. A fixture for the mounting and cooling of fluorescent tubes comprising a housing, a pair of cooling tubes mounted in said housing and disposed symmetrically with respect to a longitudinal median plane thereof, each of said cooling tubes having an upper wall heat conductively associated with said housing, a pair of flanges adjacent said upper wall of the cooling tube integral therewith and extending in the lengthwise direction thereof, a pair of side walls, a concave part-cylindrical lower wall defining a contact face and a pair of ribs integral with the cooling tube and extending in the lengthwise direction thereof adjacent said lower wall, spring means mounted in said housing adapted to engage one of said flanges adjacent the upper wall of the cooling tube so as to urge said wall against the housing in heat contact therewith, an elongated base plate extending in the lengthwise direction of the housing intermediate the cooling tubes and having upwardly extending side flanges adapted to abut the ribs of the cooling tubes, spring means adapted to suspend the base plate in the housing so as to urge the side flanges of the base plate against the lower faces of said ribs in heat contact therewith, lamp holders comprising pairs of sockets for mounting the ends of the fluorescent tubes, said lamp holders being mounted on the base plate and extending in the transverse direction thereof, and ballast means electrically connected with said sockets and mounted on the base plate adjacent said lamp holders and in heat transfer relationship with said base plate.

* * * * *